United States Patent [19]

Sanford

[11] 3,948,275

[45] Apr. 6, 1976

[54] REINFORCEMENT OF TOBACCO STRUCTURE

[75] Inventor: Robert A. Sanford, Prospect, Ky.

[73] Assignee: Brown & Williamson Tobacco Corporation, Louisville, Ky.

[22] Filed: Jan. 20, 1975

[21] Appl. No.: 542,589

Related U.S. Application Data

[63] Continuation of Ser. No. 259,296, June 2, 1972, abandoned.

[52] U.S. Cl. ..... 131/17 R; 131/140 C; 131/140 P

[51] Int. Cl.[2] A24B 3/14; A24B 13/00; A24B 18/08

[58] Field of Search .... 131/17, 140 R, 17 R, 140 P, 131/140 C

[56] References Cited

UNITED STATES PATENTS

| | | | |
|---|---|---|---|
| 2,158,928 | 5/1939 | Deich | 131/17 AC |
| 3,322,130 | 5/1967 | Panzer et al. | 131/17 |
| 3,785,385 | 1/1974 | Johnson | 131/140 P |

FOREIGN PATENTS OR APPLICATIONS

| | | | |
|---|---|---|---|
| 1,171,878 | 5/1968 | United Kingdom | 131/140 |

*Primary Examiner*—Robert W. Michell
*Assistant Examiner*—V. Millin
*Attorney, Agent, or Firm*—Finnegan, Henderson, Farabow & Garrett

[57] ABSTRACT

Expanded tobacco is appropriately treated to improve its physical strength and prevent collapse of the tobacco walls following expansion.

2 Claims, No Drawings

REINFORCEMENT OF TOBACCO STRUCTURE

This is a continuation, of application Ser. No. 259,296, now abandoned filed June 2, 1972.

BACKGROUND OF THE INVENTION

A number of patents have issued in recent years regarding the puffing or expansion of tobacco products. For example, U.S. Pat. Nos. 3,409,022 and 3,566,112 describe such processes. Other patents have also issued in this area. Each of the patents relates to a method of puffing or expanding the tobacco.

Tobacco is a fibrous, botanical product and the expansion obviously involves an increase in the area and spacing between the fibers. For this reason, expansion weakens the fibrous structure which normally comprises the tobacco part. Because of the weakness which is thus introduced, in some cases the tobacco part incorporated in a smoking product may not retain the size to which it was originally expanded. If the tobacco particle collapses, then the benefits of the expansion are totally or partially lost.

SUMMARY OF THE INVENTION

In accordance with the present invention, tobacco which has been, or is to be, expanded, is treated with an appropriate agent to reinforce the fibrous structure and thus prevent collapse of the expanded tobacco. In general, this reinforcing involves a re-bonding of the fibers of the tobacco synthetically.

As previously indicated, a tobacco particle is composed of a plurality of fibers. Accordingly, non-toxic, natural and synthetic resins normally employed for paper wet strength improvement and for textile sizings can be used to reinforce the strength of the expanded tobacco particles.

The amounts of these materials which are used can vary from about 0.25 to 5%, based upon the weight of the tobacco. Preferably, the amount is from 2 to 5%. The greatest benefit in increased strength of the tobacco particle is achieved when the agent is applied to the tobacco, in a water solution, prior to actual expansion. The energy expended in expanding the tobacco can then be simultaneously employed in curing the resin or in bonding the treating agent to the tobacco fibers.

DESCRIPTION OF THE PREFERRED EMBODIMENTS

The preferred manner of carrying out the present invention is to impregnate tobacco which is to be expanded with a solution of one of the strength improving agents. While the treatment can be applied subsequent to expansion, the preferred manner of carrying out the invention is an initial impregnation, first because the energy employed to expand the tobacco can then also be used to complete the chemical or physical reaction with the strength improving agent, and, secondly, so that there is no initial collapse of the expanded tobacco.

The solvent for the impregnating solution can be water, inert, low boiling, organic solvents, or a mixture of the two. For many reasons, including economic reasons, water is the preferred solvent. The concentration of the solution may vary from about 1 to 90%, preferably 1 to 10%, particularly when using cellulose derivatives.

Methyl cellulose can be employed according to the present invention. A solution of about 5 % methyl cellulose in water is prepared and the tobacco is impregnated with this solution in any convenient manner. The tobacco is then subjected to any expansion process, such as a treatment of the impregnated tobacco with microwave energy so as to carry out the expansion. The energy imparted to the tobacco particles by the microwave energy also acts to bind the methyl cellulose to the tobacco fibers to impart the strength improvement.

If desired, the methyl cellulose may be placed in a solution employing one of the solvents referred to in U.S. Pat. No. 3,409,022 and the tobacco impregnated with that solution. When the tobacco is heated so as to vaporize the solvent and expand the tobacco, the heat energy acts to bind the methyl cellulose to the tobacco fibers, similarly improving the strength of the tobacco particle walls and thus preventing collapse of the expanded tobacco.

The solvents which can be employed in this vaporization process include water and inert organic materials. Among these inert, organic materials are aromatic hydrocarbons, including benzene, ketones, such as acetone, methylethyl ketone, methyl isopropyl ketone, and diethyl ketone; ethers, such as diethyl ether and dimethyl ether; aliphatic alcohols, such as ethyl alcohol and methyl alcohol; aliphatic hydrocarbons, such as propane and butane; and halohydrocarbons, such as ethyl chloride, propyl chloride, isopropyl chloride, methylene chloride, methylene bromide, chloroform, carbon tetrachloride, ethylene dichloride, etc.

While the invention has just been described with regard to the use of methyl cellulose as a strength improving agent, various natural and synthetic resins can be employed in the same manner. In general, these resins are those used for improving the wet strength of the paper, or for sizing paper or textiles. Such resins include cellulose derivatives, such as ethyl hydroxy ethyl cellulose, cellulose acetate; butadienestyrene copolymers; vinyl polymers, such as, polyethylene, polypropylene; polyesters; saponified and unsaponified resin; polyvinyl alcohol. Starch and gelatin are also useful. These materials are employed in the same amounts and in the same manner as methyl cellulose. However, higher solution concentrations can be used for the non-cellulose materials.

The tobacco which can be treated according to the present invention can include either lamina or stems. In general, the processing of the tobacco parts, other than the expansion step, is not material and any treatment may be employed, so long as the materials remaining on the tobacco particles will not interfere with a bonding between the fibers of the tobacco particle and the strength improving agent. The following examples are given that those skilled in the art may be better enabled to practice the present invention. All parts in these examples, unless otherwise indicated, are by weight.

EXAMPLE 1

A quantity of 100 parts of tobacco lamina were impregnated with a 5% solution of methyl cellulose. This provided approximately 4 parts of methyl cellulose for each 100 parts of tobacco. The thus impregnated tobacco was then puffed, employing microwave energy, by the process described in copending application Ser. No. 177,268, filed Sept. 2, 1971, in the name of George Stungis, Steven Merker, Harlie A. Parish, Jr., and Richard Striegel, assigned to the same assignee as the present invention.

EXAMPLE 2

The impregnation and puffing was carried out in the same manner as in Example 1, except that the methyl cellulose was replaced with an equal quantity of unsaponified rosin. The impregnated product of Example 1 was further impregnated with a solvent and puffed in the manner set forth in U.S. Pat. No. 3,409,022.

EXAMPLE 3

The impregnated material of Example 2 was further impregnated with a solvent in accordance with U.S. Pat. No. 3,409,022 and was puffed as described in that patent.

The puffed tobacco of each of the preceding examples is compared with a tobacco puffed in the same manner, but in the absence of the strength improving agent. Under severe conditions, the untreated tobacco collapses, while the tobacco treated according to the present invention retains its expanded character.

A means for improving the ability of expanded tobacco to remain in the expanded condition has thus been shown. While various materials and processes have been specifically described, these should not be considered as limiting in any way the full scope of the invention as covered in the appended claims.

We claim:

1. An expanded tobacco particle having a fibrous structure impregnated with a non-toxic resin, said particle being produced by impregnating tobacco with from about 0.25% to about 5% by weight, based on the weight of the tobacco, of said resin, and expanding the impregnated tobacco, whereby the area and spacing between the fibers of said fibrous structure is increased, relative to the area and spacing prior to expansion, and said resin binds to the fibers of said fibrous structure, bonding and reinforcing the fibrous structure thereby increasing the physical strength of said particle and decreasing the tendency of said particle to collapse.

2. The expanded tobacco particle of claim 1 wherein said resin is methyl cellulose.

* * * * *